US012680248B1

(12) United States Patent
Fowler

(10) Patent No.: US 12,680,248 B1
(45) Date of Patent: Jul. 14, 2026

(54) MATERIAL COLLECTING APPARATUS

(71) Applicant: Kevin Herbert Fowler, Malvern (GB)

(72) Inventor: Kevin Herbert Fowler, Malvern (GB)

( * ) Notice: Subject to any disclaimer, the term of this patent is extended or adjusted under 35 U.S.C. 154(b) by 359 days.

(21) Appl. No.: 18/453,889

(22) Filed: Aug. 22, 2023

(51) Int. Cl.
*E01H 1/10* (2006.01)
*E01H 1/00* (2006.01)

(52) U.S. Cl.
CPC ..... *E01H 1/105* (2013.01); *E01H 1/005* (2013.01)

(58) Field of Classification Search
CPC ..... E01H 1/105; E01H 1/005
See application file for complete search history.

(56) References Cited

U.S. PATENT DOCUMENTS 1,997,248 A * 4/1935 Densberger ..... E01C 23/082 172/612
3,010,523 A * 11/1961 Gifford ..... A01B 43/00 56/328.1
3,409,120 A * 11/1968 Van Huis ..... A01K 1/0132 119/451
6,257,345 B1 * 7/2001 Tozer ..... E01H 1/12 172/612
9,635,800 B1 * 5/2017 Collins ..... A01K 1/01
2016/0262298 A1 * 9/2016 Anderson ..... A01B 43/00

FOREIGN PATENT DOCUMENTS

JP 2006109867 A * 4/2006
JP 2009097262 A * 5/2009
WO WO-2007015072 A1 * 2/2007 ..... A01B 31/00
WO WO-2020102848 A1 * 5/2020 ..... E01H 1/04

* cited by examiner

*Primary Examiner* — Marc Carlson
(74) *Attorney, Agent, or Firm* — QuickPatents; Kevin Prince

(57) ABSTRACT

The embodiments herein provide a material collecting apparatus with a height-adjustable towing cable. Some embodiments allow the front end to be weighted to increase downforce and may have a detachable bracing bar. The apparatus comprises a metal tray towable behind a vehicle enabling it to collect manure, rocks, sticks, molehills, fruits, nuts, balls etc. The adjustable height towing cable allows an effective connection point to the apparatus to be set higher than that of a towing point on the vehicle, leading to improved downforce and hence collection efficiency. The bracing bar may be removed or replaced with a bar having flaps for allowing passage of material in one direction whilst blocking passage in an opposite direction. As well as collecting material, embodiments may be used to level or smooth a ground surface.

8 Claims, 4 Drawing Sheets

MATERIAL COLLECTING APPARATUS

CROSS-REFERENCE TO RELATED APPLICATIONS

This application is a Continuation-in-Part of U.S. Utility patent application Ser. No. 18/203,013, filed on May 29, 2023, and incorporated herein by reference.

FIELD OF THE INVENTION

The present invention relates to the field of material collection, such as may be performed on a ground surface, and more particularly relates to apparatus that may be towed behind a vehicle and arranged to scoop up or retrieve materials from the surface.

BACKGROUND OF THE INVENTION

Background description includes information that may be useful in understanding the present invention. It is not an admission that any of the information provided herein is prior art or relevant to the presently claimed invention, or that any publication specifically or implicitly referenced is prior art.

There are known collection tools that can be used to collect manure, rocks, sticks, molehills, fruits, nuts, and any other debris, or balls, such as golf balls, baseballs, cricket balls etc. or other items, from a field or surface. One issue with known collection apparatus is it can be difficult to keep a front end of the apparatus in good contact with the ground surface when different towing vehicles are used. For example, a setup that works with one towing vehicle may be less effective when used with a different towing vehicle. Some vehicles may cause the front end of the apparatus to dig-in to the ground, or to skip too lightly over it, both of which make the task of clearing debris or collecting material inconvenient.

KR20190044601 relates to an apparatus for collecting rock which is rotated to correspond to an inclined region provided on the ground to collect rocks, and heavy construction equipment having the same. an apparatus for collecting rock, comprising: a fastening part coupled to an arm of heavy construction equipment including an excavator; a collecting member support part having one side connected to the fastening part and the other side provided with a support part; and a collection member rotatably provided on the support part to collect rocks on the ground, wherein the collection member is rotated to correspond to an inclined area provided on the ground to collect rocks.

The above-mentioned technology is used to collect only the rocks which are present on the ground and is not suitable for cleaning large areas of ground. It is only suitable for use on specialist construction equipment, such as an excavator.

CN111837481 relates to a laser ranging-based leveling machine for paddy fields. The leveling machine comprises a connecting rod, a mounting block, a mounting rod, an extension leveling mechanism, and floating cleaning mechanism, wherein the connecting rod, the mounting block, and the mounting rod are used for connecting the leveling machine to a moving device, the extension leveling mechanism can stretch and shrink to level the paddy fields, and the floating cleaning mechanism is used for automatically cleaning the machine and preliminarily cleaning floating objects in the paddy fields.

CN214592730U discloses a paddy field satellite scraper constructs for the land leveller, comprising a scraper blade, and a scraper blade height adjusting device connected between the floating piece and the scraper blade; the scraper height adjusting device comprises a support and a telescopic device, the upper end of the telescopic device is hinged to the support, the lower end of the telescopic device is hinged to the floating piece, the lower end of the support is hinged to the floating piece, and the scraper is fixed to the lower end of the support.

The above-mentioned apparatus relates to levelling of fields and is not suitable for collecting materials present on the ground.

The present application is aimed at providing a collection apparatus that is better able to maintain good contact with the ground when pulled by different vehicles, and which is usable on different surfaces.

SUMMARY OF THE INVENTION

The principal object of the embodiments herein is to create downforce on the front end of the material collecting apparatus regardless of the towing vehicle used or the surface on which the collecting apparatus is being towed.

Another object of some of the embodiments herein is to provide a solution to that problem that prevents blockage of a collection mouth opening of the material collecting apparatus due to too much matter on the surface.

Another object of the embodiments herein is to establish a towing cable height on the material collecting apparatus which is adjustable to allow it to be higher than a tow point on the vehicle being used to tow the collecting apparatus.

Another object of some embodiments of the invention is to allow for additional downforce to be created in a front end of the material collecting apparatus by allowing weights to be added thereto.

According to a first aspect of the present invention there is provided a material collecting apparatus, said apparatus comprising:

- a metal tray having a collection mouth opening on a front end, and first and second sides, the apparatus being configured to be towed behind a vehicle;
- at least one towing cable configured to attach the metal tray to a towing point on the vehicle; wherein the towing cable is received at a receiving point on the apparatus, the receiving point being on an arm, and being height adjustable so as to provide an adjustable height of the effective cable attachment point on the apparatus.

The receiving point may be movable to different positions on the arm, or the arm may be adjustable so as to change the receiving point height as the arm is adjusted.

Embodiments therefore allow the height of an effective towing point of the apparatus, i.e., a height at which a towing cable acts on the apparatus, to be adjusted. This may be done, for example, when setting up the apparatus for towing by a particular vehicle, It is advantageous to be able to vary the effective towing height, as if it is too low then the towing vehicle will tend to lift up the front end of the apparatus as it drags it forward, and if it is too high then it can cause the front end to dig into the ground. The correct height may be found by trial and error, but typically, for some embodiments, the optimal height of the effective cable attachment point may be just very slightly higher than the towing point on the towing vehicle.

Advantageously, in some embodiments, the apparatus has a pair of towing cables and a pair of adjustable arms, each located respectively on each side of the tray, where each adjustable arm has a receiving point for receiving a respective towing cable. Each such arm may comprise of an arm as described herein.

This then provides, in such embodiments, a cable connection from the vehicle to each side of the apparatus. This ensures that the mouth of the apparatus will remain facing the direction of tow.

Advantageously, after passing through the receiving point, each cable is attached to the tray. It may be attached by, for example, being passed through an eyelet or shackle mounted on a side of the tray or may be looped through a hole in the tray. Alternatively, it may be attached directly to the receiving point.

In some embodiments, the receiving point comprises of an eyelet through which the cable passes, before being fastened to the tray as stated above. The eyelet may be a solid ring, or may be shackle, a pulley, or other capture device that supports the cable at that point, preventing it from dropping down from the arm.

In some embodiments, the adjustable arm (or arms when more than one) comprises of an arm pivotally mounted at a point on the tray at a pivot point, the pivot being at or towards an opposing end of the arm to the receiving point, and wherein the arm is able to rotate to a plurality of selected angles and to be locked into position at a selected angle. In this way, as the adjustable arm is placed in different rotational positions, the height of the receiving point above a base of the tray will vary. Thus, it is possible to select different effective heights of the cable connection to the apparatus.

In some embodiments the arm is in the form of a plate, the plate having a series of holes or notches equally spaced from the pivot that provide locking points to rotationally lock the arm in place at different angles with respect to the tray. Thus, in such embodiments, the arm may have the appearance of a cam. In some embodiments the holes or notches may be arranged to align with a corresponding hole in a fixed portion of the arm or apparatus, through which a bolt or pin may be inserted, to lock the arm in a chosen position. The bolt or pin may advantageously be a spring-loaded captive bolt, pin, bar, or some other locking arrangement, thus making it particularly convenient to change the angle of the arm (and hence the height of the effective towing point of the apparatus). This may be by, for example, withdrawing the bolt or pin from the hole or notch in the plate, moving the arm to a new position, and allowing the spring to pull the bolt or pin back into a locking position. Other methods of locking the arm in position will be apparent to the normally skilled person.

In some embodiments the adjustable arm comprises of a telescopic arrangement allowing an upper section of the arm to be raised or lowered in a linear motion with respect to a lower section thereof and locked in position. The upper section of the arm may sit within the lower section, or may sit outside it, or may sit alongside, and in each case may be arranged to slide with respect to the lower portion to change the height thereof. It may use a similar locking mechanism to those described above or may use a different one.

In some embodiments the apparatus further comprises at least one detachable weight, and which is attachable to a forward position on the apparatus to provide additional downforce at the mouth of the tray. The weights may comprise any suitable, such as metal plates. The weight(s) may be arranged to attach to the tray by being bolted thereto, or by clipping on, or by any other suitable method. There may be a dedicated attachment point or points for attaching the weights to the tray. The attachment point(s) may advantageously be on sides of the tray, at or towards the front thereof. Thus, advantageously, some embodiments may allow weights to be placed on each side of the tray separately.

In some embodiments the mouth of the apparatus has a removable bar or plate passing between the two sides of the tray that, when attached, provides a limited mouth height. The bar or plate etc. may be adjustable to provide different heights at different positions. In this way the apparatus provides a way of providing selectivity as to what materials, or the size of materials, are collected.

In some embodiments the bar has one or more flaps hanging therefrom that allow material to pass into the mouth of the tray, but which prevent material from exiting the mouth. The flaps may therefore act as a one-way valve or gate. This may conveniently be used when picking up spherical, or near-spherical objects which may tend to roll out once collected. It may be used for picking up balls, such as golf balls, or any other material prone to rolling or sliding out, particularly when the apparatus comes to a stop.

Additional features of the invention will be or will become apparent to one with skill in the art upon examination of the following figures and detailed description. It is intended that all such additional features and advantages be included within this description, be within the scope of the invention, and be protected by the accompanying claims.

BRIEF DESCRIPTION OF THE DRAWINGS

Figure 1:
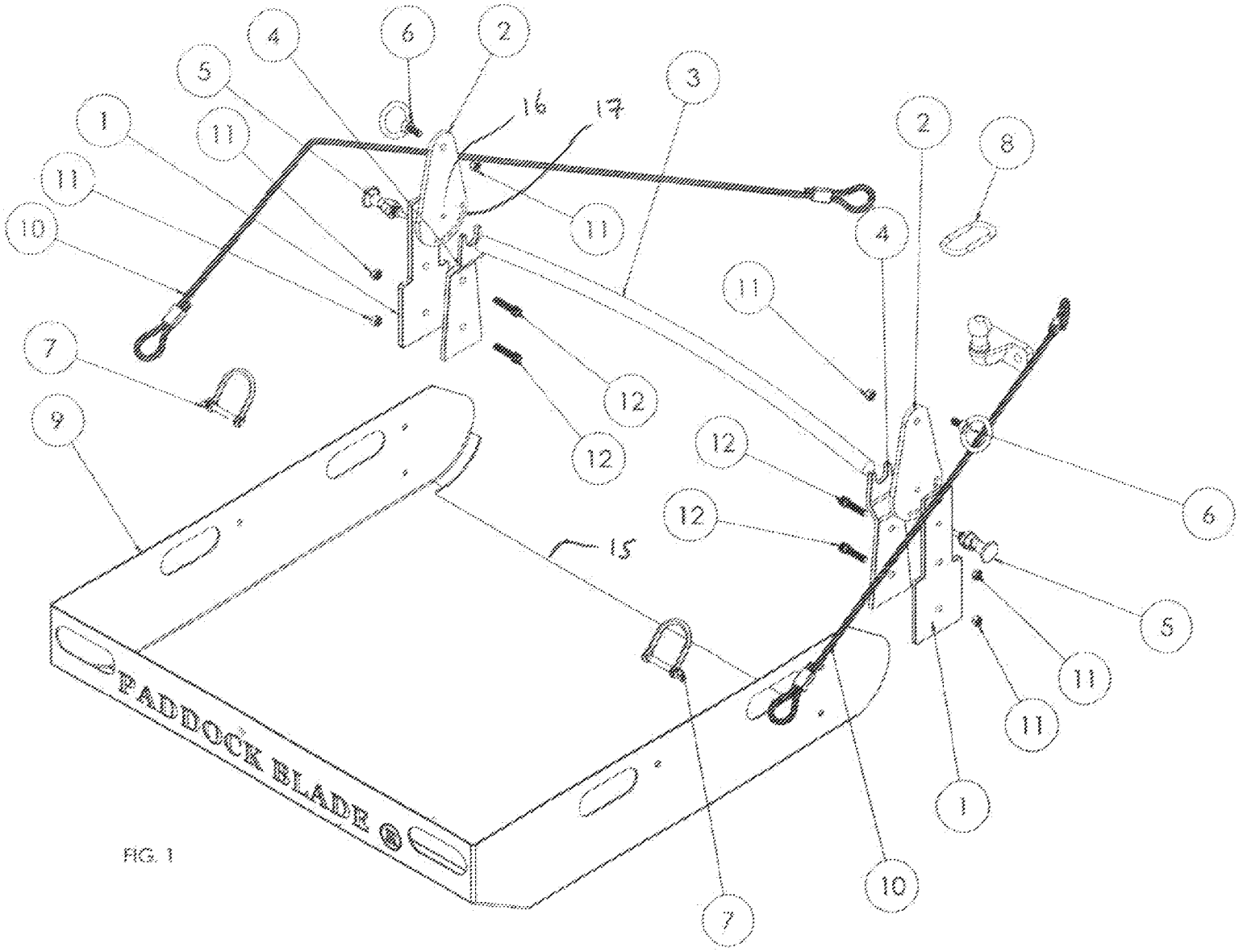
Figure 2:
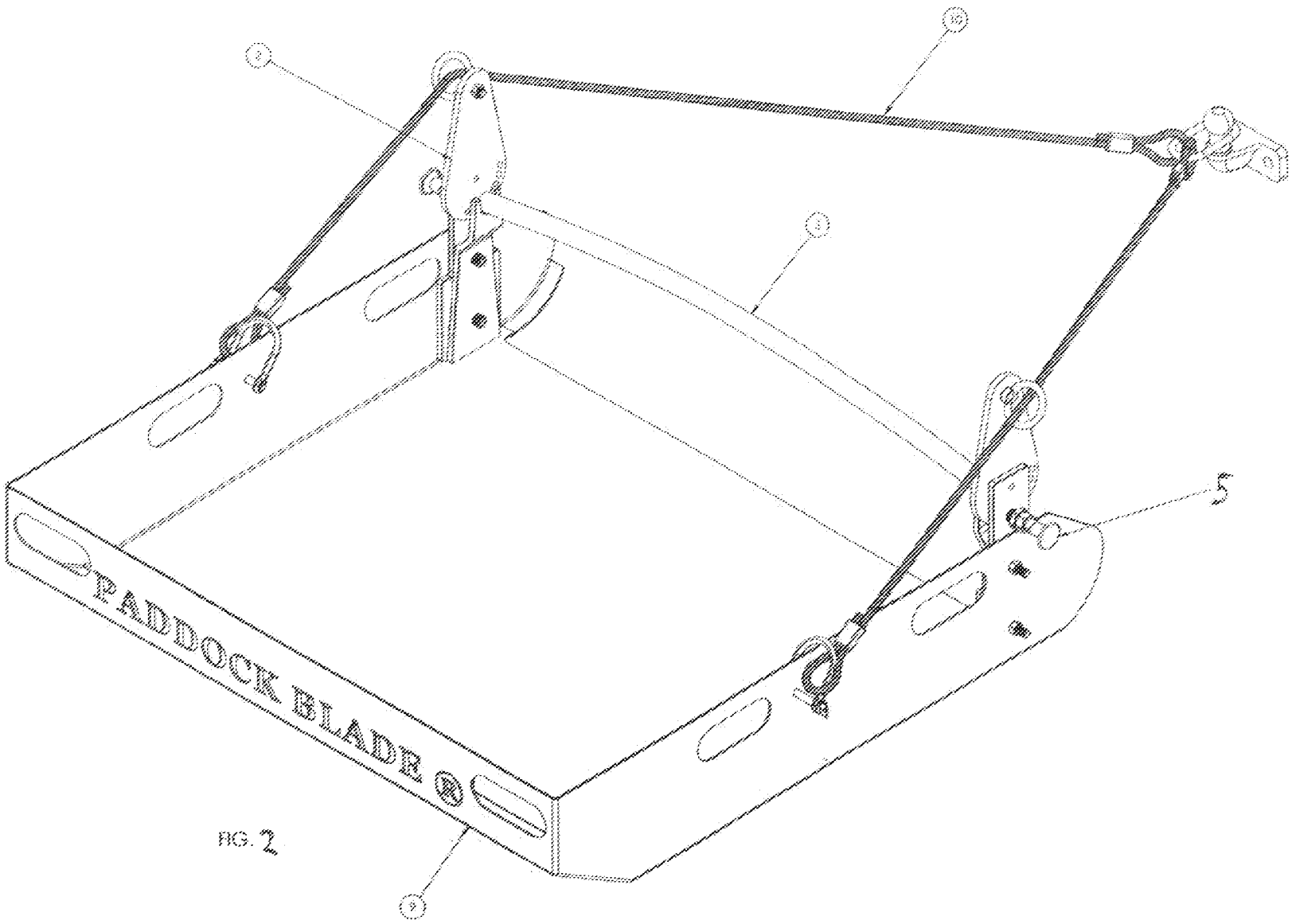
Figure 3:
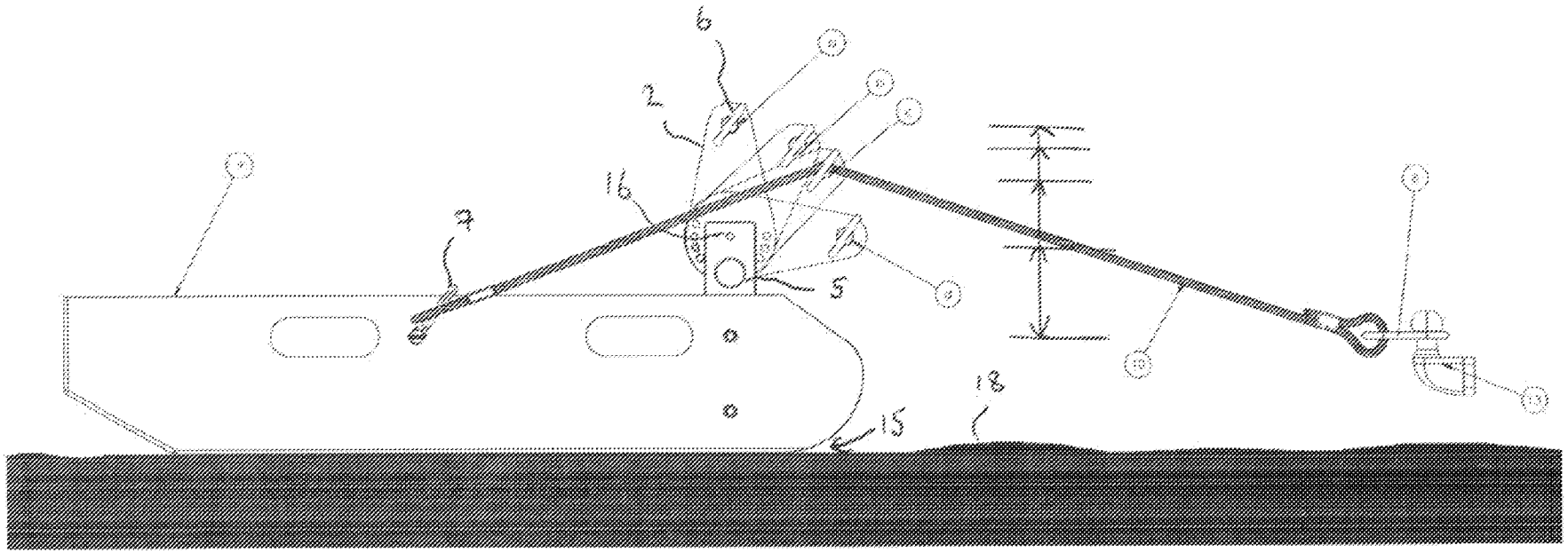
Figure 4:
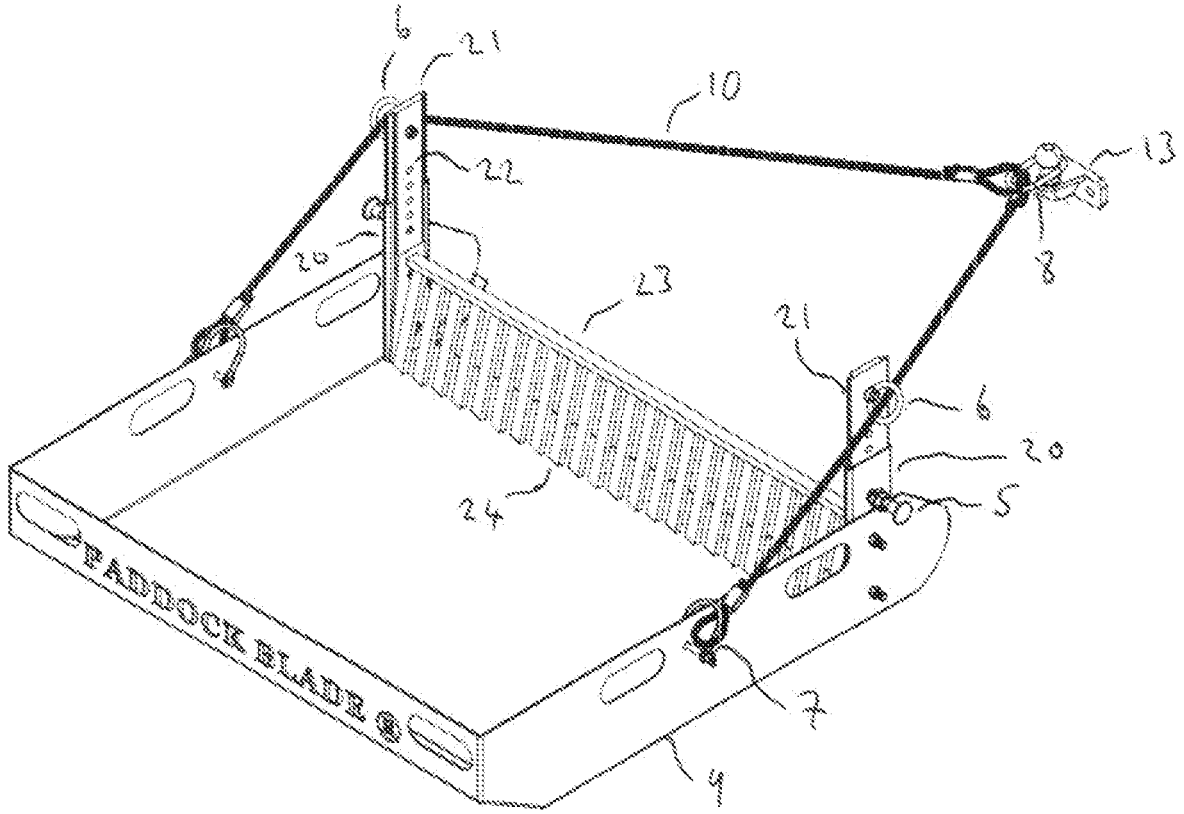

Having thus described the subject matter of the present invention in general terms, the invention will be described in more detail, by way of example only, and reference will be made to the accompanying drawings, which are not necessarily drawn to scale, and wherein:

FIG. 1 illustrates a schematic exploded view of the material collecting apparatus, in accordance with an embodiment of the present invention;

FIG. 2 illustrates a schematic view of the material collecting apparatus, and which is connected to a vehicle, depicting an adjustable towing cable height mechanism, in accordance with an embodiment of the present invention;

FIG. 3 illustrates a side view of the material collecting apparatus depicting the different positions and angles of the adjustable towing cable height mechanism, in accordance with an embodiment of the present invention; and FIG. 4 illustrates an alternative embodiment of the invention, with a collection gate preventing collected material from exiting through the mouth, and an alternative arm arrangement.

Skilled artisans will appreciate that elements in the drawings are illustrated for simplicity and may not have necessarily been drawn to scale. Furthermore, in terms of the construction of the device, one or more components of the device may have been represented in the drawings by conventional symbols, and the drawings may show only those specific details that are pertinent to understanding the embodiments of the present invention so as not to obscure the drawings with details that will be readily apparent to those of ordinary skill in the art having benefit of the description herein.

DETAILED DESCRIPTION OF THE INVENTION

The subject matter of the present invention now will be described more fully hereinafter, by way of example only, with reference to the accompanying drawings, in which some, but not all embodiments of the subject matter of the present invention are shown. Like numbers refer to like elements throughout. The subject matter of the present invention may be embodied in many different forms and should not be construed as limited to the embodiments set forth herein; rather, these embodiments are provided so that this disclosure will satisfy applicable legal requirements. Indeed, many modifications and other embodiments of the subject matter of the present invention set forth herein will come to mind to one skilled in the art to which the subject matter of the present invention pertains having the benefit of the teachings presented in the foregoing descriptions and the associated drawings. All illustrations of the drawings are for the purpose of describing selected versions of the present invention and are not intended to limit the scope of the present invention. Therefore, it is to be understood that the subject matter of the present invention is not to be limited to the specific embodiments disclosed and that modifications and other embodiments are intended to be included within the scope of the appended claims.

The term "some" as used herein is to be understood as "none or one or more than one or all." Accordingly, the terms "none," "one," "more than one," "more than one, but not all" or "all" would all fall under the definition of "some." The term "some embodiments" may refer to no embodiments or to one embodiment or to several embodiments or to all embodiments, without departing from the scope of the present disclosure.

The terminology and structure employed herein is for describing, teaching, and illuminating some embodiments and their specific features. It does not in any way limit, restrict or reduce the spirit and scope of the claims or their equivalents.

More specifically, any terms used herein such as but not limited to "includes," "comprises," "has," "consists," and grammatical variants thereof do not specify an exact limitation or restriction and certainly do not exclude the possible addition of one or more features or elements, unless otherwise stated, and furthermore must not be taken to exclude the possible removal of one or more of the listed features and elements, unless otherwise stated with the limiting language "must comprise" or "needs to include."

Whether or not a certain feature or element was limited to being used only once, either way, it may still be referred to as "one or more features" or "one or more elements" or "at least one feature" or "at least one element." Furthermore, the use of the terms "one or more" or "at least one" feature or element do not preclude there being none of that feature or element, unless otherwise specified by limiting language such as "there needs to be one or more . . . " or "one or more element is required."

Unless otherwise defined, all terms, and especially any technical and/or scientific terms, used herein may be taken to have the same meaning as commonly understood by one having ordinary skills in the art.

Reference is made herein to some "embodiments." It should be understood that an embodiment is an example of a possible implementation of any features and/or elements presented in the attached claims. Some embodiments have been described for the purpose of illuminating one or more of the potential ways in which the specific features and/or elements of the attached claims fulfil the requirements of uniqueness, utility, and non-obviousness. Features from one embodiment may, unless technically infeasible, be used with other embodiments.

In accordance with an embodiment of the present invention, FIG. 1 illustrates a schematic exploded view of the material collecting apparatus, and FIG. 2 shows a similar view in non-exploded form. FIGS. 1 and 2 show a material collecting apparatus which comprises a metal tray 9 having a collection mouth 15 opening on a front end configured to be towed behind a vehicle, a tow loop 8 configured to attach the metal tray 9 with a towing point positioned on the back side of the vehicle. The tray 9 has a base plate on which collected matter is gathered, and side and back panels to prevent collected matter from falling out of the tray.

Each side of the tray 9 has an associated towing cable 10 connected thereto by shackle 7, towards a rear part of the side. The towing cable passes through an eyelet 6 before extending forwards to the tow loop 8. The eyelet on each side is connected to an upper point on an adjustable arm. The eyelet therefore defines a receiving point for the tow rope 10. Each adjustable arm 2 is rotationally attached to the side of the tray 9 by means of a connection plate 4. The adjustable arm has a pivot point 16 about which it is able to rotate, and a set of holes 17 that are provided to allow the arm to be locked in a chosen position by means of a locking pin 5 mounted on plate 1 that is able to fit into one of the holes 17 in the arm. Thus, by choosing different locking positions, the height of the eyelet above the mouth is adjustable.

This allows a height to be chosen depending on the height of the towing point on the towing vehicle. It is advantageous to choose higher eyelet heights with higher towing points, as this helps to prevent the mouth from lifting up above the surface of the ground when being towed, and hence failing to collect material.

Bolts 12 are used to fasten various items, as would be appreciated by the skilled person. Rivets, clips, or some other fastener may alternatively be used as appropriate.

Further shown in FIGS. 1 and 2 is a removable weight plate 1 on each side of the metal tray 9 located towards the front of the tray, near the mouth 15. It provides additional downforce at the front end of the metal tray 9. The plates 1 are bolted to the sides of the tray 9. Additional plates may be bolted onto those to increase the weight further if required.

A bracing bar 3 is attached to the sides of the tray 9 and sits above the mouth 15 to give additional strength to the apparatus. The height of the bar above the mouth can be adjusted, by bolting it into different positions.

FIG. 3 shows a side view of an embodiment of the invention, coupled to a towing point on a vehicle. Like reference numerals are used to refer to similar items to those shown in FIGS. 1 and 2. Tray 9 is on a piece of ground 18 with mouth 15 in contact with the ground. The tray has coupled thereto a towing cable 10 that is connected at one end to a towing point 13 on a vehicle via a tow-loop 8. The towing cable 10 passes through a receiving point comprising an eyelet 6 mounted at an upper point on arm 2, that is itself rotationally connected to the tray. The cable 10 then connects to the tray at shackle 7, mounted on a side of the tray. The viewpoint of FIG. 3 only shows one cable, but it will be appreciated that there is a cable on each side of the tray, as shown in FIG. 2.

The arm 2 is shown in four different positions, labelled a) b), c) d) respectively, with the cable being shown as it passes through the eyelet 6 with the arm in position c). It can be seen that each position a-d gives a different height of eyelet 6 above the towing point 13. The height of the eyelet (i.e., the height of the receiving point) with respect to the towing point affects how the tray 9 behaves as it is pulled along by the vehicle. If the receiving point is too low then the tray will tend to skip along the ground, pulling the mouth up out of contact thereof, and so not providing efficient collection. If it is too high, then it can tend to tilt the tray up as it is pulled which may spill collected material back onto the ground. The optimal height of the receiving point is generally higher than the towing point on the vehicle but may also be arranged to sit above a line between towing point 13 and shackle 7 which may be below a towing point of the vehicle. The optimal height of the receiving point may vary according to other variables, such as the type of ground, the material being collected, the speed of the towing vehicle etc. hence it is useful to have the ability to change the receiving point height easily.

The arrangement shown in FIG. 3 allows easy height adjustment by means of pulling on locking pin 5, which, when removed, allows arm 2 to rotate about pivot point 16. Pin 5 sits, in its locked position, in one of the holes 17 as well as in plate 1. Hence, the arm is locked an unable to rotate. When the pin is pulled from the arm 2, the arm may be rotated to a selected height, and the pin 5 is then inserted into the nearest hole 17 that aligns with the pin location.

FIG. 4 shows another embodiment of the invention, this embodiment being similar in some ways to the previous embodiment but having some differences. The embodiment again comprises a tray 9, towing cables 10 arranged to attach to a towing point 13 of a vehicle. This embodiment differs in having an alternative arm arrangement, and also having an alternative bracing bar arrangement having flaps to help retain collected material.

In more detail, tray 9 has, located on each side thereon an arm comprising of a fixed retaining portion 20 and a sliding portion 21. The sliding portion is retained within the fixed portion such that it is able to move relative to the fixed portion in a vertical axis but is stopped from moving in any other axis. On an upper part of the sliding portion 21 is located an eyelet 6 that retains towing cable 10 and so provides a receiving point for the apparatus. The fixed portion 20 of the arm has located thereon a spring-loaded locking pin 5. The sliding portion of the arm has a series of holes 22 drilled therein that are arranged to align with locking pin 5, such that the locking pin, when in a locked position, passes through one of the holes and so prevents vertical movement of the sliding portion. In this way a height of the eyelet 6 relative to the base of the tray may be easily adjusted, providing flexibility with regard to how the cables sit when the apparatus is being towed, as with the previously discussed embodiments.

Bracing bar 23 sits above a mouth of the tray, and the bar 23 has a series of flaps 24 that hinge at the bar allowing each flap 24 to rotate back towards the rear of the tray, but which are too long to be able to move forward from a resting point on the tray. Thus, the totality of the flaps 24 provide a one-way-valve or gate that does not significantly impede material entering the tray but prevents material in the tray from passing back off the tray through the mouth. This is convenient for when the tray is used to collect highly mobile items such as golf balls or other balls or spherical objects, prone to rolling out.

Embodiments of the invention are particularly useful in environment such as farms, equestrian areas, paddocks, playing fields, sports grounds etc., where they may be used to collect, for example:

manure
sticks
rocks, stones, gravel, loose soil etc.
organic debris
golf balls, baseballs etc.
nuts and fruit
surface debris, such as to level surfaces.

The invention may be further understood from the following numbered paragraphs.

1. A material collecting apparatus, said apparatus comprising:
   a metal tray having a collection mouth opening on a front end configured to be towed behind a vehicle;
   a tow loop configured to attach the metal tray with a towing point positioned on the back side of the vehicle, two towing cables on the left side and the right side of the metal tray attached to the tow loop by hydraulically crimped ferrules connected to a cam on each side of the metal tray which is in turn connected to an eyelet or shackle on each side, wherein the metal collecting apparatus comprises a removable weight plate on each side on a proximal end of the metal tray configured to provide additional downforce for ensuring a solid ground plane at the front end of the metal tray, and wherein the metal collecting apparatus further comprises an elevation pin for the cams on each side of the metal tray configured to adjust the height of the cams by engaging and disengaging into a plurality of hole positions provided on the surface of each cam.
2. The apparatus of paragraph 1, wherein engaging and disengaging the elevation pin into the plurality of hole positions provided on the surface of each cam also changes the height of the two towing cables.
3. The apparatus of paragraph 1, wherein the cam on each side of the metal tray is connected to a bracing bar which extends across the collection mouth opening of the metal tray.
4. The apparatus of paragraph 1, wherein the bracing bar can be round or square in shape.
5. The apparatus of paragraphs 1 or 2, wherein the bracing bar can be individually removed to allow a larger opening at the collection mouth opening of the metal tray.
6. The apparatus of paragraph 1, wherein the metal tray is having a base plate and a periphery forming a space behind the collection mouth opening configured to hold the collected materials.
7. The apparatus of paragraph 1, comprising at least two brackets on each side on the proximal end of the metal tray configured to hold the cam in between, by using a plurality of nuts and bolts.
8. The apparatus of paragraph 7, wherein the plurality of nuts and bolts passes through a connecting hole for attaching the at least two brackets holding the cam on the proximal end of the metal tray.
9. The apparatus of paragraph 1, comprising an eyelet on each side of the metal tray configured to attach the two towing cables to the cam on the left side and the right side of the metal tray.
10. The apparatus of paragraph 1, comprising a shackle on the left side and the right side of the metal tray, behind the collection mouth opening configured to tie a distal end of the two towing cables.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof, and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

All publications, patent applications, patents, and other references mentioned in the specification are indicative of the level of those skilled in the art to which the presently disclosed subject matter pertains. All publications, patent applications, patents, and other references are herein incorporated by reference to the same extent as if each individual publication, patent application, patent, and other reference was specifically and individually indicated to be incorporated by reference. It will be understood that, although a number of patent applications, patents, and other references are referred to herein, such reference does not constitute an admission that any of these documents forms part of the common general knowledge in the art. Although the foregoing subject matter has been described in some detail by way of illustration and example for purposes of clarity of understanding, it will be understood by those skilled in the art that certain changes and modifications can be practiced within the scope of the appended claims.

The invention claimed is:

1. A material collecting apparatus, said apparatus comprising:

a metal tray having a collection mouth opening on a front end, and first and second sides, the apparatus being configured to be towed behind a vehicle;

at least one towing cable configured to attach the metal tray to a towing point on the vehicle;

wherein the towing cable is received at a receiving point on the apparatus, the receiving point being on an arm, and being height-adjustable so as to provide an adjustable height of the effective cable attachment point on the apparatus;

wherein the arm is adjustable in position, and wherein different adjustment positions provide different heights of the receiving point above the mouth;

wherein the adjustable arm comprises of an arm pivotally mounted at a point on the metal tray at a pivot point, the pivot being at or towards an opposing end of the arm to the receiving point, and wherein the arm is able to rotate to a plurality of selected angles and to be locked into position at a selected angle.

2. An apparatus as claimed in claim 1 wherein the arm is in the form of a plate, the plate having a series of holes or notches equally spaced from the pivot that provide locking points to rotationally lock the arm in place at different angles with respect to the metal tray.

3. An apparatus as claimed in claim 1 wherein the adjustable arm comprises of a telescopic arrangement allowing an upper section of the arm to be raised or lowered in a linear motion with respect to a lower section thereof, and locked in position.

4. An apparatus as claimed in claim 1 wherein the apparatus further comprises at least one detachable weight, and which is attachable to a forward position on the apparatus to provide additional downforce at the collection mouth opening of the metal tray.

5. An apparatus as claimed in claim 4 wherein the apparatus further comprises an attachment point on each side of the tray at a forward position, allowing weights to be attached on each side of the metal tray.

6. An apparatus as claimed in claim 1 wherein the collection mouth opening has a removable bar between the two sides of the metal tray that, when attached, provides a limited mouth height.

7. An apparatus as claimed in claim 6 wherein the removable bar is adjustable between different positions to provide different mouth heights at different positions.

8. An apparatus as claimed in claim 6 wherein the removable bar has one or more flaps hanging therefrom that allow material to pass into the mouth of the metal tray, but which prevent material from exiting the collection mouth opening.

* * * * *